US005174144A

United States Patent [19]

Kajiwara et al.

[11] Patent Number: 5,174,144

[45] Date of Patent: Dec. 29, 1992

[54] 4-HIGH ROLLING MILL

[75] Inventors: Toshiyuki Kajiwara; Hideotoshi Nishi, both of Hitachi; Tokuji Sugiyama, Ibaraki, all of Japan

[73] Assignee: Hitachi, Ltd., Tokyo, Japan

[21] Appl. No.: 684,178

[22] Filed: Apr. 12, 1991

[30] Foreign Application Priority Data

Apr. 13, 1990 [JP] Japan ..... 2-096452
May 16, 1990 [JP] Japan ..... 2-124119

[51] Int. Cl.[5] ..... B21B 27/02; B21B 28/04; B21B 31/18

[52] U.S. Cl. ..... 72/236; 72/241.2; 72/247; 72/252.5; 29/110

[58] Field of Search ..... 72/241.8, 247, 252.5, 72/366.2, 9, 12, 199, 241.2, 236; 29/110

[56] References Cited

U.S. PATENT DOCUMENTS 3,733,878 5/1973 Anderson et al. ..... 72/243.6
4,703,641 11/1987 Yarita et al. ..... 72/247
4,781,051 11/1988 Schultes et al. ..... 72/199
4,823,585 4/1989 Hishinuma et al. ..... 72/247

FOREIGN PATENT DOCUMENTS 1153586 9/1983 Canada ..... 29/110
0212002 3/1987 European Pat. Off. ..... 72/247
51-7635 3/1976 Japan .
54-145356 11/1979 Japan .
55-64908 5/1980 Japan .
57-91807 6/1982 Japan .
57-181708 11/1982 Japan .
0212802 12/1983 Japan ..... 72/247

*Primary Examiner*—Lowell A. Larson
*Assistant Examiner*—Thomas C. Schoeffler
*Attorney, Agent, or Firm*—Evenson, Wands, Edwards, Lenahan & McKeown

[57] ABSTRACT

A 4-high-rolling mill includes a pair of upper and lower works, a pair of upper and lower backup rolls supporting the upper and lower work rolls, respectively, a roll bending device for applying a bending force to the upper and lower work rolls, and a roll shift device for shifting the upper and lower work rolls in an axial direction of the work rolls. Each of the upper and lower work rolls has a curved initial crown portion formed on one side portion of a barrel of the work roll which is not less than a half of the length of the work roll barrel, and a substantially cylindrical initial crown portion formed on the remainder of the work roll barrel. Teh curve of the curved initial crown portion approximates to a curve represented by the formula $Y=X^n$, ($n \geqq 1.5$), and the curved initial crown portions of the upper and lower work rollers are disposed oppositely relative to each other in the axial direction of the work rolls, and always disposed in overlapping relation to each other at least a part thereof.

17 Claims, 14 Drawing Sheets

4-HIGH ROLLING MILL

BACKGROUND OF THE INVENTION

This invention relates to a 4-high rolling mill of the work roll shift type, and more particularly to a 4-high rolling mill which has an excellent ability of controlling a plate crown and a plate shape of a material to be rolled, and enables a schedule-free rolling.

In recent years, the functions required for a rolling mill (particularly, a hot strip mill) are a schedule-free rolling and a rolling for highly precisely controlling a plate crown and a plate shape of a material to be rolled. The term "schedule-free rolling" means the type of rolling in which any desired width of the material to be rolled can be freely selected, with no limitation imposed on the order of selection of widths of the material.

The type of mill capable of achieving this function is known as HCW mill as disclosed in Japanese Patent Examined Publication No. 51-7635. In this system, the plate crown and plate shape of the material to be rolled are controlled by the shift of intermediate rolls and work roll benders, and wear of the roll surface is dispersed by a cyclic shift of the work rolls, thereby achieving the schedule-free rolling. Therefore, it is inevitable for this mill to be of the 6-high type requiring the intermediate roll shift and the work roll shift. In a finish mill (hot strip mill) of the tandem type, a later-stage stand requires a small torque, and also the plate thickness is small, and therefore the size of the rolling mill is not unduly increased even if the 6-high rolling mill is used, because the diameter of the work rolls can be made small. However, a preceding-stage stand requires the work rolls of a large diameter, and therefore if the 6-high rolling mill is used, its size becomes enormous.

Therefore, this function must be achieved by a 4-high rolling mill. If the system disclosed in Japanese Patent Examined Publication No. 51-7635 is applied to a 4-high rolling mill, it is necessary to move an end of the effective length of the roll barrel to a position near an end of the width of the material to be rolled in order to decrease the plate crown, and in this condition the rolling is carried out. Therefore, when the material to be rolled is displaced from the center of the mill, there occurs a disadvantage that the material to be rolled is disengaged from the barrels of the work rolls. Further, in this system, when the work rolls are reciprocally moved (that is, shifted in a cyclic manner) in order to disperse wear of the work rolls, the end of the roll barrel may be spaced more than 200 mm from the lateral edge of the material to be rolled, because the amplitude of this cyclic shift is about ±100 mm. At this time, any extra force for amending the plate crown does not already remain in a roll bender at all. If a roll crown is formed on the peripheral surface of the roll barrel, this difficulty can be overcome; however, this roll crown is limited to a slightly convex shape in order to prevent the plate crown from having a concave shape when the width of the material is wide. Therefore, the plate crown can not be effectively controlled when the material width is small. When a decrease bender is used, it is possible to increase the roll crown. However, the decrease bender must be switched to a roll balance when the material is passed between the work rolls, and therefore there is encountered a disadvantage that the passage of the material through the work rolls is unstable. Further, in this HCW mill system, the load of contact of the end portion of the work roll barrel with the backup roll is high, and the lifetime of the backup roll is shortened particularly in a heavy-load rolling. Therefore, generally, the HCW mill is conventionally used to deal with the wear of the rolls.

Japanese Patent Unexamined Publication No. 57-91807 discloses a mill of the work roll shift type. An S-shaped concave-convex roll crowns are formed on peripheral surfaces of the barrel of work rolls, and the upper and the lower work roll are disposed in reverse relation to each other (In other words, one of the upper and the lower work roll is turned through 180° relative to the other). In this mill, the work rolls are shifted so as to geometrically change the shape of a roll gap between the two work rolls in the axial direction of the work rolls. A feature of this mill is that a change of the plate crown relative to the shift amount is large. In this case, a backup roll barrel and the work roll barrel are in contact with each other generally over their entire lengths, and therefore a great effect of a work roll bender as achieved in the HCW mill cannot be expected.

In this type of mill, when the work rolls are cyclically shifted so as to disperse wear of the rolls, the plate crown is greatly varied. The amount of shift of the work roll in the above-mentioned mill is around ±100 mm, so that the plate crown is changed from the maximum to the minimum. On the other hand, when the work roll is cyclically shifted by an amount of ±100 mm in order to achieve the roll wear dispersion, the plate crown is cyclically varied. This plate crown variation cannot be amended by such a work roll bender having a small effect.

Namely, the mill of the above type cannot effect a schedule-free rolling, though it has a plate crown control ability.

Another 4-high rolling mill having a large plate crown control amount is one called "a pair cross mill" as disclosed in Japanese Patent Unexamined Publication no. 55-64908. In this type of mill, upper and lower work rolls, as well as backup rolls, are disposed horizontally, with their axes intersecting each other, so that the profile of the amount of a vertical roll gap between the work rolls can be changed so as to control the plate crown. In this type of mill, if only the work rolls are disposed in intersecting relation to each other, a slip occurs between the work roll and the backup roll, so that a roll wear and a large thrust are produced. To avoid this, it is necessary that the backup rolls for receiving the rolling load should also be disposed in intersecting relation to each other. As a result, the mill has a large and complicated construction. Further, a spindle for driving each work roll is angularly moved in accordance with a vertical position change of the work roll, and also is inclined in a horizontal direction for the intersection of the work rolls, so that the overall angle of each spindle is increased. Therefore, a universal joint suited for such a large angle change is needed. However, since the rotational speed is changed in accordance with the above horizontal inclination angle, a gear-type spindle suited for a small angle change must be used, and therefore the intersection angle is limited. Further, in order that this pair cross mill can achieve a schedule-free rolling, it is very important how wear of the work roll can be dealt with.

One means for dealing with this problem to add the function of shifting each work roll in its axial direction.

With this arrangement, however, the axial shift mechanism is further added to the horizontally-intersecting work rolls, so that the construction becomes extremely complicated. Such a mill, used in a severe environment in which the load, the impact, the heat and water are applied, is not satisfactory in reliability and maintenance.

Another means for dealing with the above problem is to provide roll grinders in a rolling mill, as disclosed in Japanese Patent Unexamined Publication No. 54-145356. When a work roll is subjected to wear, the peripheral surface of the work roll barrel is ground by the roll grinder so that the roll crown can be always kept to the same shape before the wear. In this mill, many roll grinders for applying a large grinding load are required so as to sufficiently compensate for the wear of the work rolls. As a result, the size of the rolling mill is increased, and also the cost for the maintenance such as the exchange of many whetstones is increased.

Japanese Patent Unexamined Publication No. 57-181708 discloses a 4-high rolling mill provided with work rolls shiftable in the direction of the axis thereof. Each of the work rolls has a convex initial crown formed axially over less than a half of its length, and the two work rolls are so arranged that their convex initial crown portions are disposed oppositely relative to each other. Each of the backup rolls either has a convex initial crown which is formed over the entire length thereof and is symmetrical with respect to the center of its length, or has a convex initial crown which extends over less than a half of its length and is disposed oppositely relative to the initial crown of the work roll.

The two work rolls are shifted in opposite directions in accordance with the width of a material to be rolled, and each of the lateral edges of the material to be rolled is positioned between the initial crown portion of one of the work rolls and the cylindrical portion of the other work roll, and in this condition the rolling is carried out. During the rolling, the pressure applied to the lateral edge portions of the material to be rolled is reduced by the initial crowns of the work rolls, thus controlling the edge drop of the material to be rolled. Also, the contact pressure between the work rolls and the backup rolls are reduced by the initial crown of the backup rolls, thus controlling the plate crown of the material to be rolled. By combining these two effects, the plate crown and the plate shape are controlled.

As described above, in this rolling mill, when the rolling is carried out, each of the lateral edges of the material is positioned between the initial crown portion of one work roll and the cylindrical portion of the other work roll. In other words, the major portion of the material to be rolled is rolled between the straight portions of the work rolls. Therefore, it is difficult to control the plate crown at these portions. The contact pressure between the work rolls and the backup rolls is excessive, so that the wear of the straight portion becomes large. As a result, the plate crown and the plate shape are not controlled satisfactorily, and also the schedule-free rolling cannot be effected.

Generally, the backup rolls are not mounted on the rolling mill in such a manner that they are frequently exchanged. Therefore, the backup rolls having the initial crown must be used for a long period of time, and the initial crown of the backup rolls cannot be maintained. As a result, it is difficult to maintain a high-precision control of the plate crown. If the backup rolls are frequently exchanged, the time of stop of the rolling mill required for the exchange becomes long, and the production efficiency of the rolling mill is lowered. Further, it is necessary to provide such a construction as to facilitate the exchange of the backup rolls.

SUMMARY OF THE INVENTION

It is an object of the present invention to provide a 4-high rolling mill and a rolling method, by which an equivalent crown amount can be increased and decreased to a desired value by an axial shift of work rolls, and a variation of this equivalent crown amount can be restrained within the range of a cyclic shift of the work rolls.

According to the present invention, there is provided a 4-high rolling mill comprising: a pair of upper and lower work rolls for rolling a material to be rolled; a pair of upper and lower backup rolls supporting the upper and lower work rolls, respectively; a roll bending device for applying a bending force to the upper and lower work rolls; and a roll shift device for shifting the upper and lower work rolls in an axial direction of the work rolls; each of the upper and lower work rolls having a curved initial crown portion formed on one side portion of a barrel of the work roll which is not less than a half of the length of the work roll barrel, and a substantially cylindrical initial crown portion formed on the remainder of the work roll barrel, the curve of the curved initial crown portion approximating to a curve represented by an expression of the "n"th order, ($n \geqq 1.5$), and the curved initial crown portions of the upper and lower work rolls being disposed oppositely relative to each other in the axial direction of the work rolls, and always disposed in overlapping relation to each other at at least a part thereof.

The above 4-high rolling mill may further comprise a rolling grinding device movable in the direction of the work rolls so as to grind the initial crown portion of each of the upper and lower work rolls to maintain the curve of the initial crown portion.

In a rolling method of the present invention employing the above 4-high rolling mill, each of the upper and lower work rolls is shifted axially in such a manner that the end of the effective length of the work roll barrel is disposed outwardly of a lateral edge of the material to be rolled, and each of the upper and lower work rolls is shifted cyclically axially within a predetermined range during the rolling operations.

In the present invention, the material to be rolled is always rolled at those regions of the work rolls including the curved initial crown portions. In other words, the roll crown is always offered during the rolling operation, and therefore the plate crown and the plate shape can be easily controlled.

Further, each of the upper and lower work rolls has the curved initial crown portion (whose shape approximates to a curve represented by an expression of the "n"th order, $n \geqq 1.5$) formed on one side portion of the barrel of the work roll which is not less than a half of the length of the work roll barrel, and a substantially cylindrical initial crown portion formed on the remainder of the work roll barrel. Therefore, when the work rolls are axially shifted in accordance with the width of the material to be rolled, a smaller roll crown is provided for the wide material, and a large roll crown is provided for the narrow material. This is an ideal feature of the plate crown control. Namely, the plate crown control as well as the plate shape control can be carried out ideally, and the materials of various widths can be rolled with one kind of work rolls.

When the material is rolled between the curved initial crown portions of the upper and lower work rolls, a variation of the roll gap is small even if the upper and lower work rolls are axially shifted, and by compensating for this variation by the roll bender, the work rolls can be cyclically shifted axially within a predetermined range. By doing so, the wear of the work rolls due to the rolling is dispersed, the initial crown of the work rolls can be maintained for a long period of time. As a result, it is possible to perform the rolling operation of the narrow material after the rolling operation of the wide material is performed, and the limitation on the order of the rolling operation with respect to the width of the material to be rolled can be eliminated. Thus, it is possible to perform a so-called schedule-free rolling.

When the work roll is worn after a long period of use, only the end portion of the curved initial crown portion is ground by the roll grinding device, so that the curved initial crown of the work roll is recovered. Therefore, the frequency of exchange of the work roll is reduced, thereby enhancing the production efficiency.

BRIEF DESCRIPTION OF THE DRAWINGS

FIGS. 2 and 4 are schematic views of a conventional 4-high rolling mill having work rolls each having a right-left symmetrical roll crown, showing the condition of rolling of a wide material to be rolled and the condition of rolling of a narrow material to be rolled, respectively;

DESCRIPTION OF THE PREFERRED EMBODIMENTS

A basic principle of a 4-high rolling mill according to the present invention will be described wit reference to FIGS. 1 to 4. Shown in these Figures are 4-high rolling mills in which upper and lower work rolls 1, 2 for rolling a material to be rolled 3 are supported by backup rolls 21, 22, respectively. Work roll bending devices and work roll shift devices are omitted in these Figures.

Figure 1:
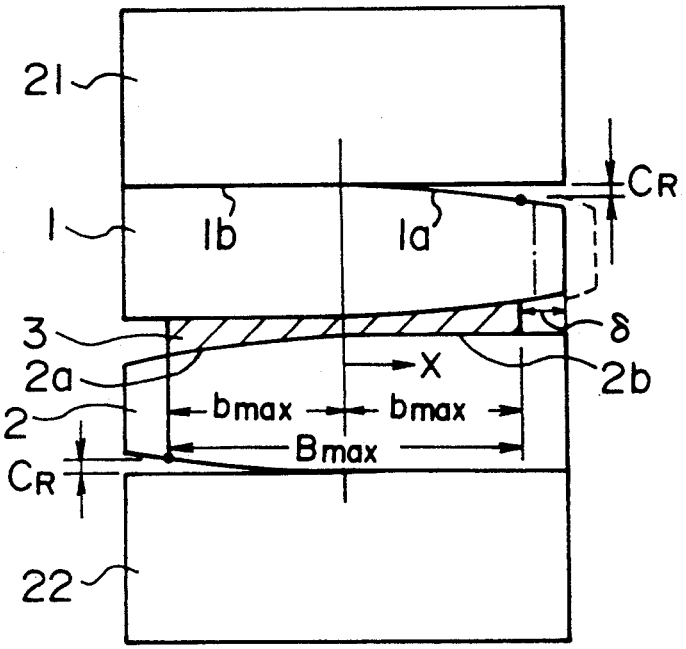
FIGS. 1 and 2 are schematic views of a 4-high rolling mill of the work roll shift type provided in accordance with the present invention, showing the condition of rolling of a wide material to be rolled and the condition of rolling of a narrow material to be rolled, respectively.
Figure 2:
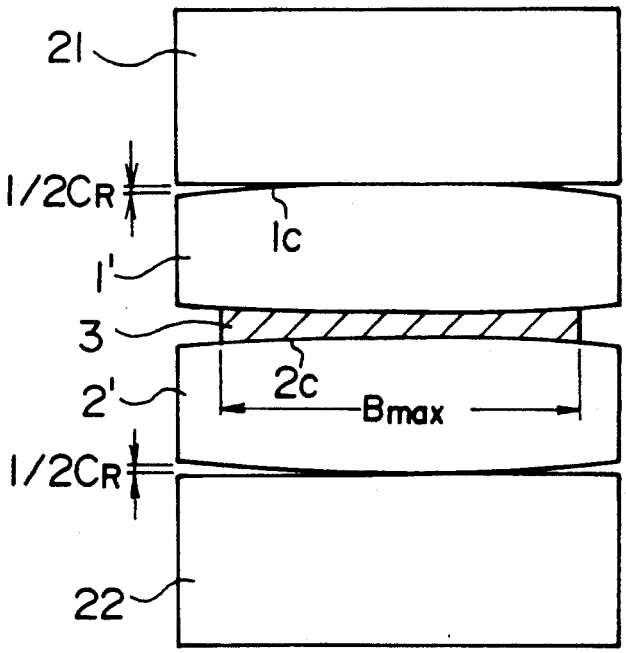
FIG. 2 PRIOR ART
Figure 3:
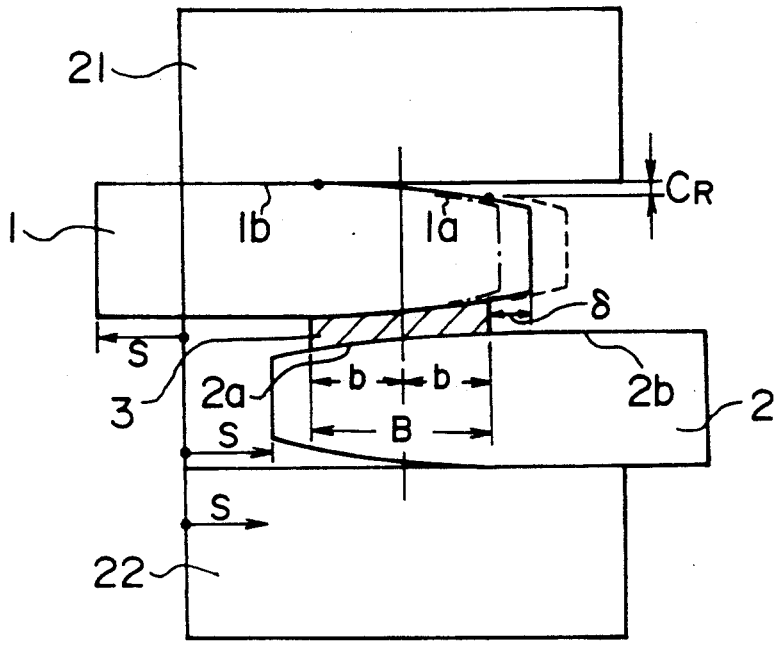
Figure 4:
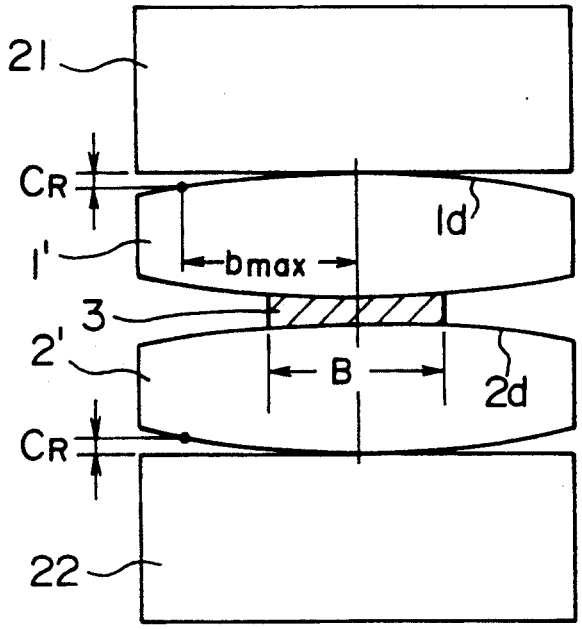
FIG. 4 PRIOR ART

A feature of the 4-high rolling mill of the present invention is a special roll crown shown in FIG. 1. Each of the upper and lower work rolls 1, 2 has an initial crown 1*a*, 2*a* formed on the roll barrel and extending over not less than a half of the length of the roll barrel, the initial crown having a curved-shape, represented by an expression of the "n"th order so as to have a crown amount $C_R$. The remainder of the roll barrel of each of the upper and lower work rolls 1, 2 has a substantially cylindrical initial crown 1*b*, 2*b*. The upper and lower work rolls 1, 2 are so arranged that their curved initial crowns 1*a*, 2*a* are disposed oppositely relative to each other. The 4-high rolling mill of this construction is equivalent to a conventional 4-high rolling mill (FIG. 2) which comprises work rolls 1', 2' (each symmetrical with respect to its center) having respective roll crown 1*c*, 2*c* each having a crown amount $\frac{1}{2}$ $C_R$. When the work rolls, 1, 2 are in the condition shown in FIG. 1, only the curved roll crown la of the upper work roll 1 serves as the roll crown substantially at the right side whereas only the curved roll crown 2*a* of the lower work roll 2 serves as the roll crown substantially at the left side. Next, when the width of the material to be rolled 3 is decreased from the maximum value Bmax to value B, the work rolls 1, 2 are shifted in their axial direction, as shown in FIG. 3. At this time, a region of the material rolled between the curved roll crown portions (having the respective curved roll crowns 1*a*, 2*b*) of the upper and lower work rolls 1, 2 gradually increases (that is, the roll crown increases), and when the value B becomes about a half of the maximum value Bmax, the material is rolled only by the curved roll crown portions of the upper and lower work rolls 1, 2 over the entire width of the material. The crown effect at this time is equivalent to that of conventional work rolls (FIG. 4) which has a crown amount $2C_R$.

Each of the one-side curved roll crowns 1*a*, 2*a* shown in FIG. 1 is represented by the expression of the "n"th order and is mainly a quadratic curve. Reference is now made to how the roll crown effect by the roll shift is varied depending on the kind of this curve. The curve of the curved roll crown 1*a*, 2*a* is expressed by $Y=C_RX^n$, with the center point of the roll used as the origin. Here, X represents a non-dimensioned coordinate in the axial direction of the roll.

When the work rolls 1, 2 are shifted an amount S from the position (reference position) of FIG. 1, the profile of the roll gap, that is, the plate crown C(X), is expressed by the following formulas when X is non-dimensioned by setting Bmax/2 be X=1:

In the case of $-S \leqq X \leqq S$.

$$C(X)=C_R(S+X)^n+C_R(S-X)^n-2C_RS^n.$$

In the case of $X \geqq S$. $C(X)=C_R\{(X+S)^n-2S^n\}$ (1)

In the case of $X \leqq -S$. $C(X)=C_R\{(S-X)^n-2S^n\}$ (1)'

Figure 5:
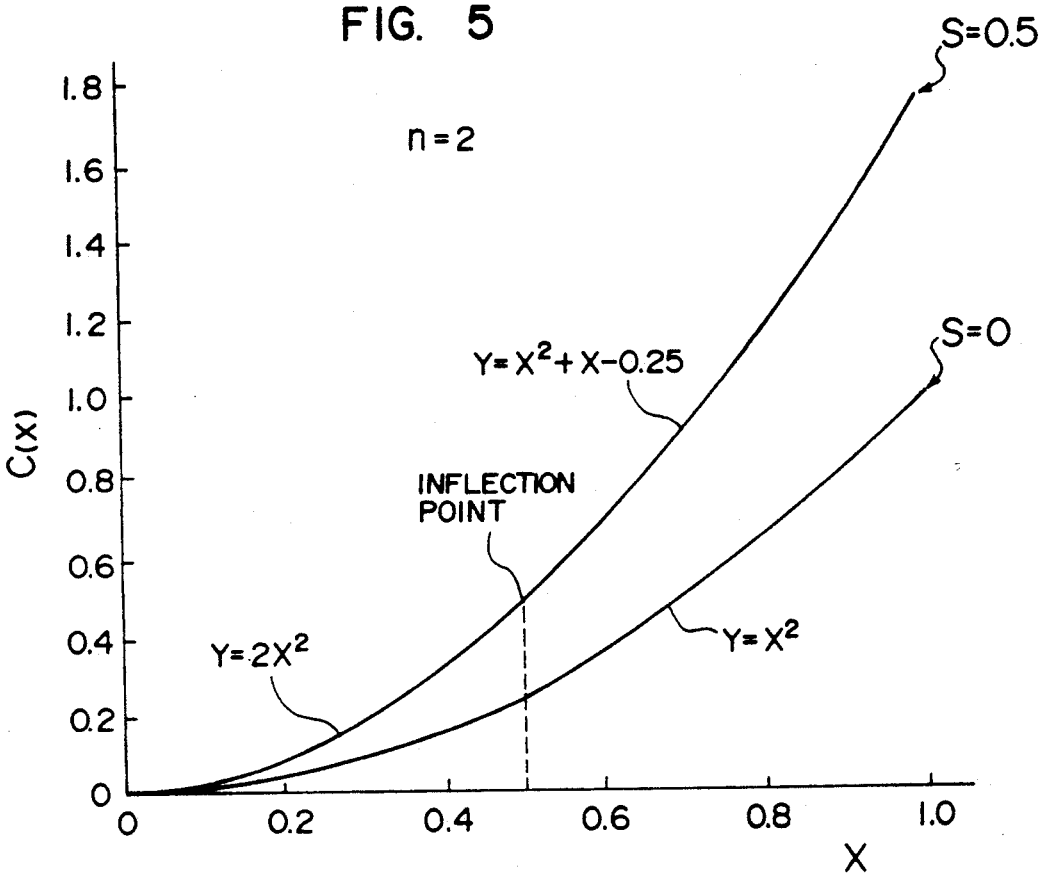
FIG. 5 is a graph showing the relation between a plate crown C(X) and an axial position of the roll in examples of roll curves applied to the initial crown of the work roll of the 4-high rolling mill of the present invention.

Although such roll curve cannot be expressed by one formula, it is a smooth curve with either of S=0 and S=0.5, as shown in FIG. 5 (n=2).

The equivalent crown amount Cr relative to the overall length of the roll barrel is expressed as follows from the formula (1) with X=1:

$$Cr=C_R\{(1+S)^n-2S^n\} \quad (2)$$

Here, if Cr obtained with S=0.5 is represented by CrE, and if its crown increase rate $\alpha$ is represented by $\alpha=CrE/C_R$, then the following is obtained:

$$\begin{aligned}\alpha &= C_R\{(1 = 0.5)^n - 2 \times 0.5^n\}/C_R \\ &= 1.5^n = 2 \times 0.5^n\end{aligned}$$

Figure 6:
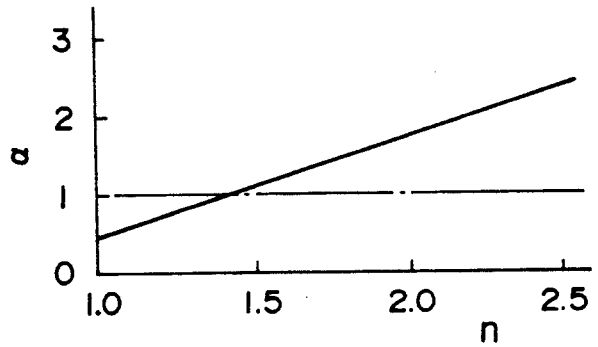
FIG. 6 is a graph showing the relation between the crown increase rate $\alpha$ and the order or degree of an "n"th-order expression approximating to the initial crown of the work roll of the rolling mill according to the invention.

If $\alpha$ is less than 1, $\alpha$ is meaningless. The value of $\alpha$ relative to the value of n is shown in FIG. 6. It will be appreciated from FIG. 6 that n should be at least 1.5.

Figure 7:
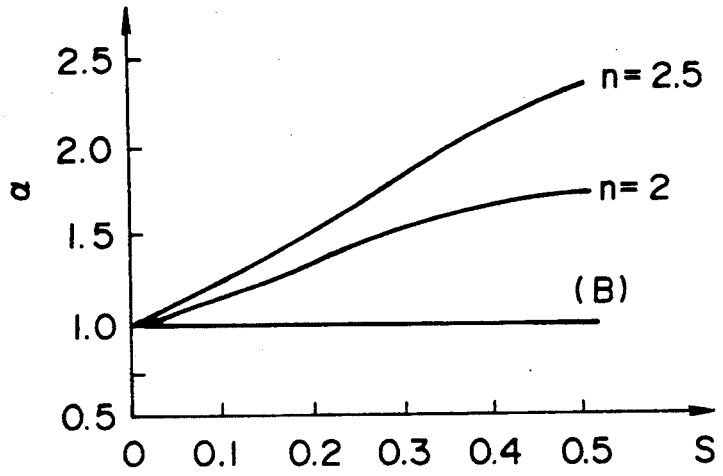
FIG. 7 is a graph showing the relation between the crown increase rate $\alpha$ and the axial shift of the work roll (having the initial crown) of the rolling mill of the invention.

As can be seen from FIG. 6, $\alpha$ increases with n; however, if n becomes too large, it does not agree with the flexing characteristics of the work roll, so that it becomes a complex crown. Therefore, it is desirable that the maximum value of n should be limited to 2.5. FIG. 7 shows how the crown increase rate $\alpha$ is varied with the shift S with respect to n=2.0 and n=2.5. The crown increase rate due to the work roll shift is larger with n=2.5 than with n=2; however, if it becomes too large, the crown variation due to the cyclic shift (the reciprocal movement of the work rolls in their axial direction within a predetermined range) of the work rolls for the purpose of dispersing the roll wear becomes unduly large, and therefore it is not advisable to increase n too much.

There have been extensively used hot strip mills having a roll barrel length capable of rolling materials having the maximum width of 1600 mm, 1800 mm or 2000 mm. However, the average width of the materials to be actually rolled is around 1000 mm, and the minimum width of the material is about 600 mm. Thus, the rolling with respect to the material width of around 1000 mm is most frequently carried out, and the roll wear with respect to this material width is most severe. Therefore, the cyclic shift of the work rolls for dispersing the wear is most important for such material width, and it is desirable that the variation of the roll crown due to this cyclic shift should be small. The present invention provides effective means for dealing with such situation. The advantages of the rolling mill according to the present invention will now be described. The roll crown of the work rolls of the 4-high rolling mill of the present invention is expressed as follows from the formula (1) when n=2 is provided:

$$\begin{aligned}C(X) &= C_R\{(X + S)^2 - 2S^2\} \\ &= C_R(X^2 + 2SX^2 - S^2)\end{aligned} \quad (3)$$

The change $\Delta C(X)$ of C(X) obtained when S is changed by $\Delta S$ is expressed as follows:

$$\Delta C(X) = \frac{\partial C(X)}{\partial S}\Delta S = 2C_R(X - S)\Delta S \quad (4)$$

Assuming that the material width is B, only the position ($-b/bmax \leqq X \leqq b/bmax$) of the work roll is important, and if its end is represented by Xb, then Xb=b/bmax is obtained. And, the following is obtained from the formula (4):

$$\Delta C(Xb)=2C_R(Xb-S)\Delta S \quad (5)$$

If Xb=1 (i.e., b=bmax) is provided, S is close to zero, and therefore the following is obtained:

$$\begin{aligned}\Delta C(Xb = 1) &\approx 2C_R(1 - 0)\Delta S \\ &= 2C_R\Delta S\end{aligned}$$

If the material width is about a half of the maximum material width as mentioned above, there are provided b=bmax/2 and Xb=0.5. In this case, S is shifted by bmax−b, and by the non-dimensioning, there is obtained S=(bmax−b)/bmax=0.5. From the formula (5), there is obtained $\Delta C(Xb=0.5)=2C_5(0.5-0.5)\Delta S=0$. The crown variation due to the roll shift hardly occurs.

Incidentally, $S \geqq 0.5$ is obtained with $b = \leqq 0.5$ bmax, and the material is rolled between the roll curves in the form of a quadratic curve. Therefore, any geometrical variation of the initial roll crown due to the roll shift does not occur. Incidentally, if it is desired to prevent the geometrical crown variation due to the roll shift in the case of b>0.5 bmax, this can be done by extending the starting point of the curved initial crown of the work roll toward the cylindrical portion of the work roll.

What is emphasized here is whether or not the roll crown having such special effects is known from the prior art. This will now be discussed with reference to the S-shaped roll curve described in the above-mentioned Japanese Patent Unexamined Publication No. 57-91807.

In the type of mill having the above S-shaped roll curve, the stroke of the roll shift is small as described above, and the crown variation due to the roll shift is extremely large, and therefore it is impossible to perform the cyclic shift. In this case, for example, it can be considered that the S-shaped roll crown is decreased, and that this is compensated for by increasing the roll stroke. However, in the mill of the above type, the roll curve for practical use is in the form of a sine curve or an odd function such as $X^3$. Its geometrical effects will now be described with respect to $X^3$.

$$Y(X)=\{(X+S)^2-(X-S)^3\}C_R=(6SX^2+2S^3)C_R$$

$$C(\mathrm{i}\ X)=Y(X)-Y(0)=6C_RSX^2 \quad (6)$$

The change $\Delta C(X)$ of $C(X)$ obtained when S is shifted by $\Delta S$ is expressed as follows:

$$\Delta C(X)=\frac{\partial C(X)}{\partial S}\Delta S=6C_RX^2\Delta S \quad (7)$$

Thus, this is proportional to $\Delta S$ regardless of the position of S.

From the formula (6), the equivalent crown Cr relative to the overall length of the roll barrel is expressed as $Cr=6C_RS$ when $X=1$ is provided, and as is clear from $\delta Cr/\delta S=6C_R=\text{const}$, the equivalent crown Cr is constant regardless of the position of S.

On the other hand, when the above-mentioned crown of the rolling mill according to the present invention is used as the initial crown of the work roll, the following is obtained from the formulas (4) and (5) in the range of the material width:

$$\frac{\partial C(Xb)}{\partial S}=2C_R(Xb-S)$$

When this is expressed as the equivalent crown Cr relative to the overall length of the roll barrel, the roll curve is expressed as a quadratic curve in the following:

$$\frac{\partial Cr(Xb)}{\partial S}=\frac{\partial C(Xb)}{\partial S}\times\left(\frac{1}{Xb}\right)^2=2C_R(Xb-S)\frac{1}{Xb^2} \quad (8)$$

In this case, the work roll is shifted by S in its axial direction in accordance with the change of b, and $S=0$ is obtained with $Xb=1$, and $S=0.5$ is obtained with $Xb=0.5$, thus providing $Xb+S=1$. However, in the case of $S\leqq 0.5$, the following is obtained as mentioned above:

$$\frac{\partial Cr(Xb)}{\partial S}=0$$

Figure 8:
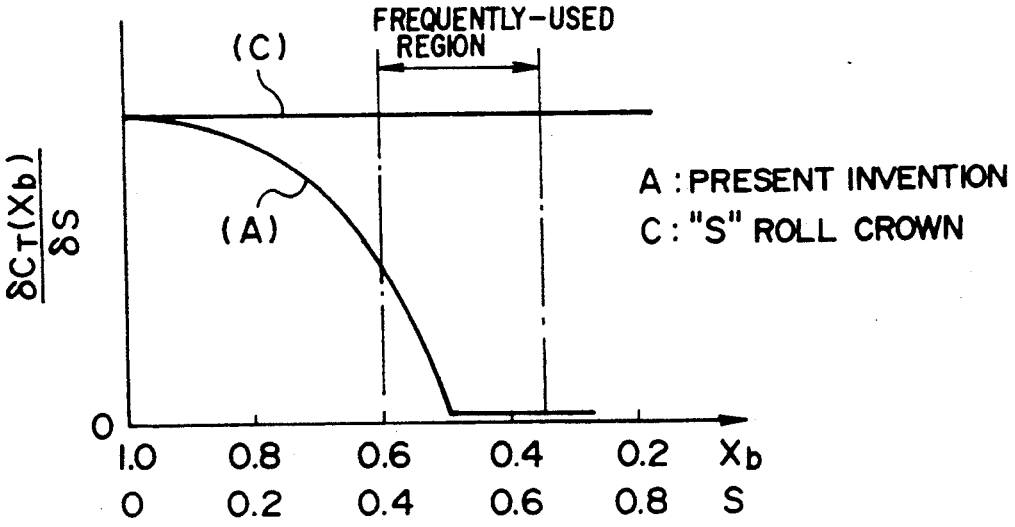
FIG. 8 is a graph showing the relation between the shift and axial position of the work roll (having the initial crown) of the rolling mill of the invention and a variation of the plate crown.

A comparison between the values of $\delta Cr(Xb)/\delta S$, obtained respectively by the S-shaped roll crown and the roll curve of the work roll of the mill of the present invention, is indicated in FIG. 8.

In FIG. 8, a curve (A) represents the roll crown of the present invention, and a straight line (C) represents the S-shaped roll crown. In the range of the most frequently-used material width, a large variation of the plate crown caused by the roll shift is unavoidable with respect to the above S-shaped roll crown whereas with respect to the roll crown of the present invention, the plate crown variation due to the roll shift can be kept to a small value while ensuring a sufficient roll crown as the absolute value. Namely, a typical example of wide hot strip mill has a roll barrel length of 2200 mm, and the maximum material width is 2000 mm, and the minimum material width is 600 mm, and the most frequently-used material width is around 1000 mm. In FIG. 8, the most frequently-used material width corresponds to $Xb=0.5$ and $S=0.5$. The relatively frequently-used sheet width of 1200 mm corresponds to $Xb=0.6$ and $S=0.4$. When Xb is not more than 0.6, the plate crown variation due to the roll shift is much smaller with the roll crown of the present invention than with the conventional S-shaped roll crown, and it will be appreciated that the schedule-free rolling can be quite effectively carried out by the rolling mill of the present invention.

Figure 9:
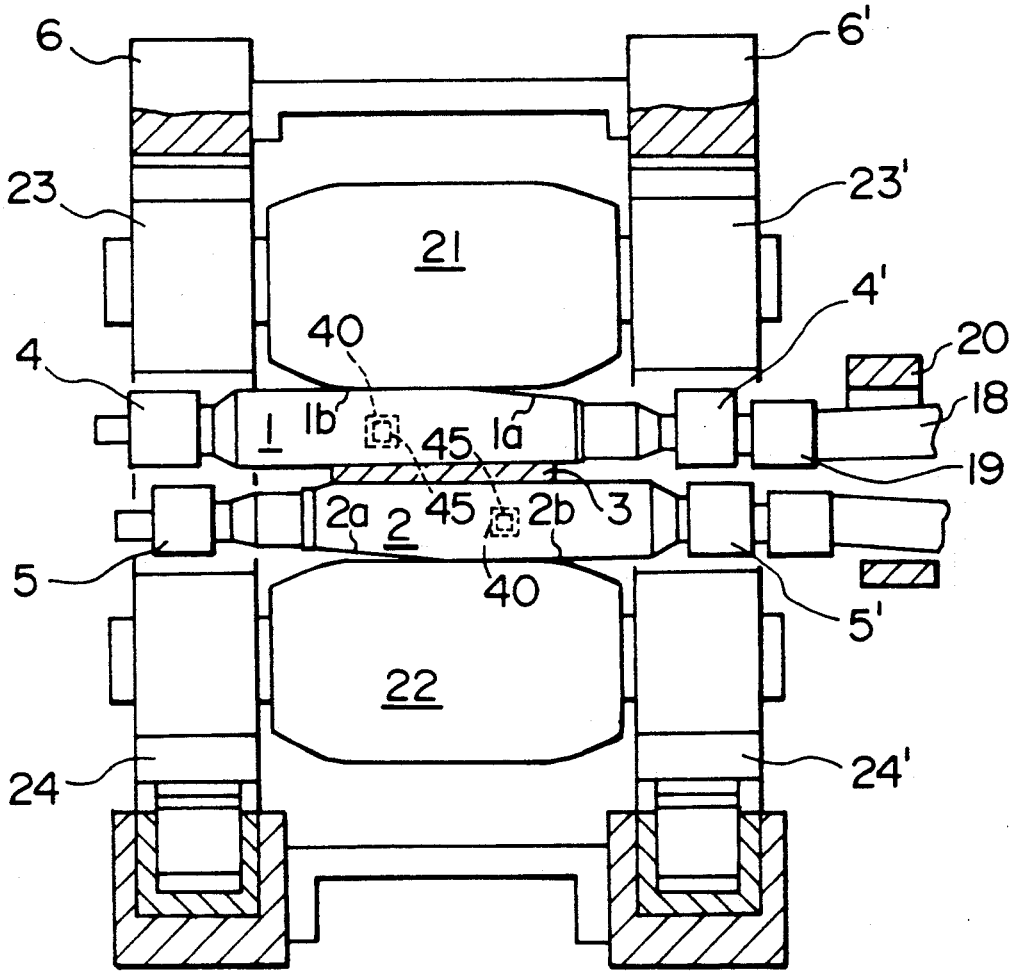
FIG. 9 is a detailed view of a 4-high rolling mill of the work roll shift type according to the invention, as seen in the direction of rolling.
Figure 10:
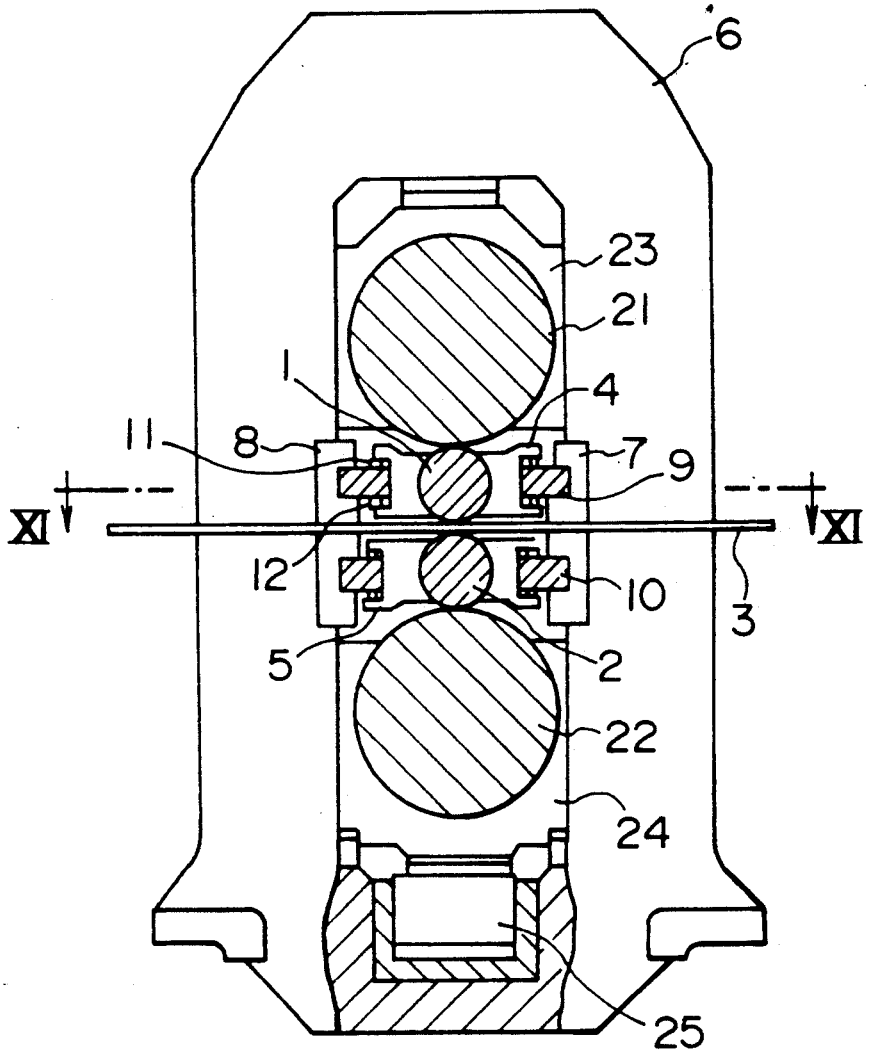
FIG. 10 is a side sectional view of the mill of FIG. 9.
Figure 11:
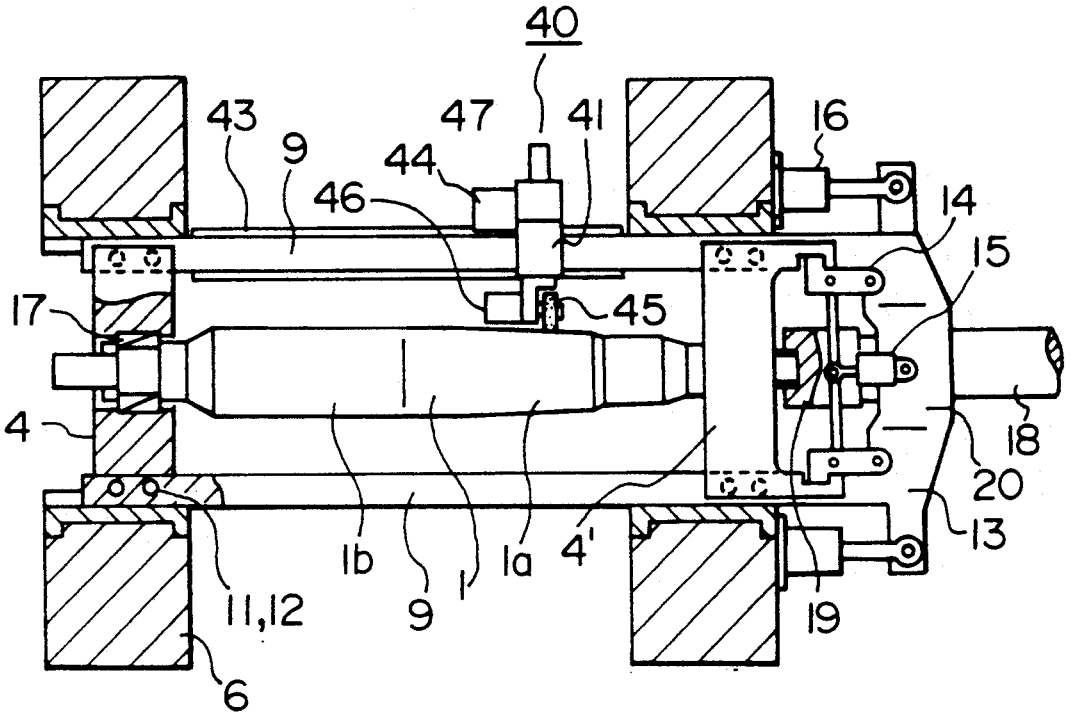
FIG. 11 is a cross-sectional view taken along the line XI—XI of FIG. 10.

One preferred embodiment of a 4-high rolling mill of the present invention is shown in FIGS. 9 to 11. In these Figures, a pair of upper and lower work rolls 1, 2 for rolling a material 3 are supported by backup rolls 21, 22, respectively. Roll neck portions (opposite end portions) of the work roll 1 are rotatably supported by metal chocks 4, 4', and similarly roll neck portions (opposite end portions) of the work roll 2 are rotatably supported by metal chocks 5, 5', respectively. Project blocks 7, 8 are mounted on a window formed in a roll housing 6, and shift blocks 9, 10 are mounted on the project blocks 7, 8. The metal chocks 4, 5 are slidably guided respectively by the insides of the shift blocks 9, 10, and the metal chocks 4, 5 can be moved, together with the work rolls 1 and 2, upward and downward in a vertical direction. Hydraulic rams 11, 12, constituting roll benders for applying roll bending force to the work rolls 1, 2, are suitably contained in the shift blocks 9, 10.

The shift block 9 constituting a roll shift device is connected to a shift beam 13 at the drive side of the rolling mill, and the drive-side metal chock 4' is releaseably connected to the shift beam 13 via chock clamps 14, this releaseable connection being achieved by a hydraulic cylinder 15. Therefore, the upper work roll 1 can be moved, together with the shift block 9, by roll shift hydraulic cylinders 16, and the upper metal chocks 4, 4' and the hydraulic rams 11, 12 contained in the shift block 9 are moved in unison in the roll axis direction. Therefore, even if the upper work roll 1 is shifted or moved a long stroke, the roll bending force can always be exerted on the center of each bearing 17 for the work roll. With this arrangement, a long lifetime of the bearing 17 is ensured, and a large roll bending force can be applied to the roll.

A drive shaft 18 serves to drive the upper work roll 1 for rotation, and is driven by a motor (not shown) via a coupling 19 so as to drive the upper work roll 1. A central portion 20 of the shift beam 13 is of such a shape (e.g. bow-shape) that the shift beam 13 and the drive shaft 18 do not interfere with each other.

Although not shown in the drawings, if the same construction as described for the upper work roll 1 is provided for the lower work roll 2, the upper and lower work rolls 1, 2 can be moved in opposite directions along the axes thereof of and the roll bending force can be effectively applied.

The upper and lower backup rolls 21, 22 support the upper and lower work rolls 1, 2, respectively, and are rotatably supported by upper backup roll metal chocks 23, 23' and lower backup roll metal chocks 24, 24', respectively. The upper and lower backup rolls 21, 22 are moved upward and downward within the window of the roll housing 6 by a reduction cylinder 25. An initial crown may be formed on each of the upper and lower backup rolls 21, 22, as shown in FIG. 9. In this case, the same effect as described above can be obtained.

Figure 18:
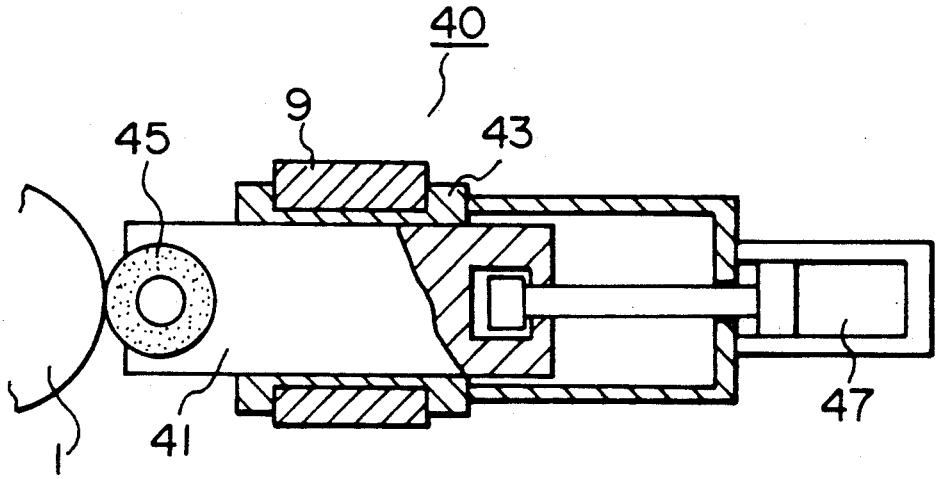
FIG. 18 is a partly cross-sectional view of a rolling grinding device used in the 4-high rolling mill of the invention.

Roll grinding devices 40 for respectively grinding the peripheral surfaces of the roll barrels of the upper and lower work rolls 1 and 2 so as to form roll initial crowns 1*a*, 1*b* as later described are constructed as shown in FIGS. 11 and 18. More specifically, a body 41 of the roll grinding device 40 is movably supported on a guide block 43 which is mounted on the shift block 9 in parallel relation to the work roll. The grinding device body 41 is moved by a travel device 44 driven by a motor or the like. A whetstone 45 is driven by a motor 46 so as to grind the work roll 1, and is pressed by a hydraulic cylinder 47 against the work roll 1 under a desired pressure, thereby grinding this work roll. When the work roll is to be exchanged, the grinding device body 41 is guided and supported by the guide block 43, and only the upper work roll 1 is removed together with the chocks 4, 4', and is exchanged by another roll.

If the same grinding device 40 is also provided on the shift block 10 for the lower work roll 2, desired portions of the peripheral surfaces of the roll barrels of the upper and lower work rolls 1, 2 can be ground under a desired pressing force, thereby producing desired roll initial crowns.

Figure 12:
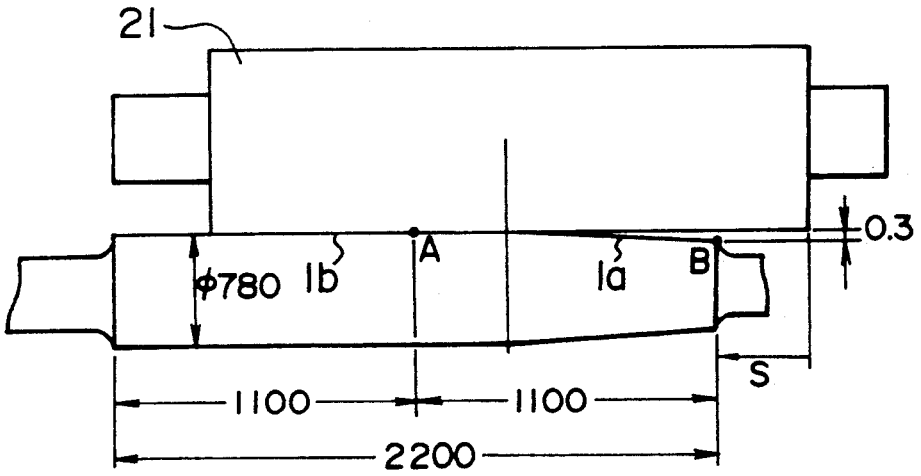
FIG. 12 is a view showing the shape of the initial crown of the work roll of the 4-high rolling mill of FIG. 9.

FIG. 12 shows one example of the roll initial crown 1*a*, 1*b* (2*a*, 2*b*) formed on the upper and lower work rolls 1, 2. More specifically, the work roll 1, having a roll barrel length 2200 mm and a roll diameter of 780 mm, is tapered from a generally central point A of its roll barrel toward the right end thereof (FIG. 12), and the initial crown la of a roll curve represented by $y=x^2$ is formed over this region. The radius of the roll barrel end at point B is smaller 300 $\mu$m than the radius at the point A. On the other hand, the opposite portion of the roll barrel from the point A to the left end thereof is substantially not changed in diameter to provide a straight-like or cylindrical initial crown 1*b*.

The approximate expression for the curved initial crown la formed on the one-side portion of the roll barrel of the work roll 1 is represented by $y=x^n$. Although necessary effects can be obtained with $n \geqq 1.5$, it is preferred that n is in the range of 2.0 to 2.5.

Figure 13A:
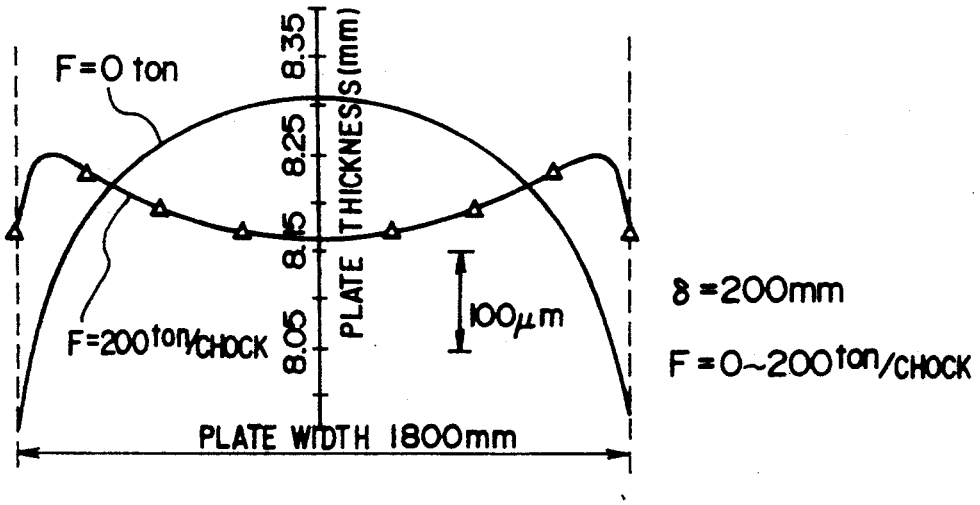
FIGS. 13A to 13C are illustrations of plate crown profiles showing the plate crown control by the 4-high rolling mill of the invention.
Figure 13B:
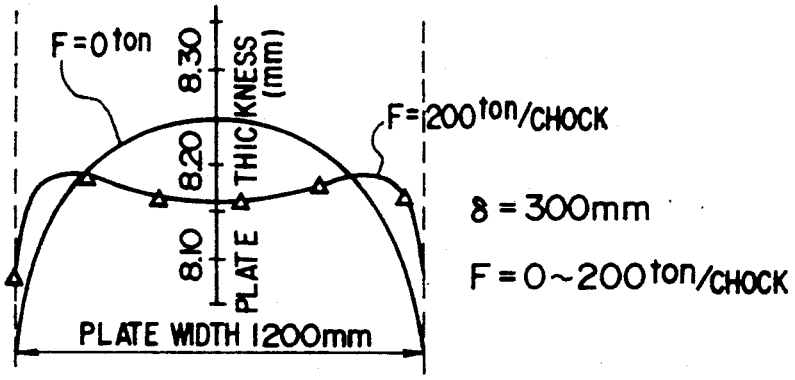
Figure 13C:
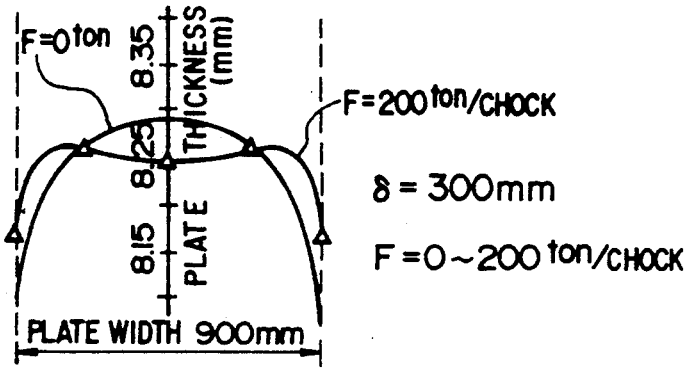
Figure 14A:
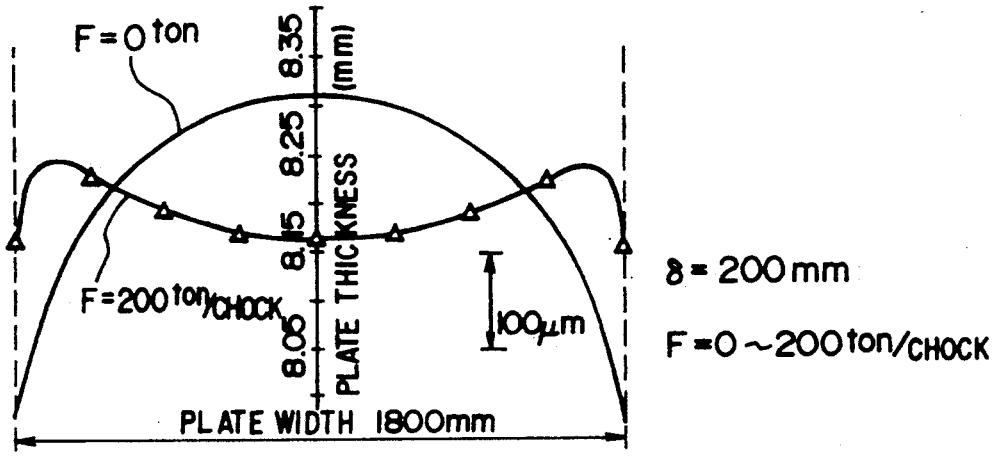
FIG. 14A PRIOR ART
FIGS. 14A to 14C are illustrations of plate crown profiles showing the plate crown control by a conventional 4-high rolling mill.
Figure 14B:
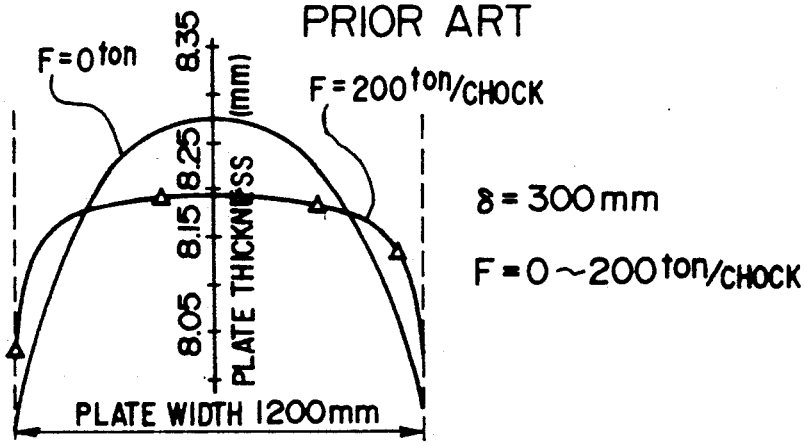
FIG. 14B PRIOR ART
Figure 14C:
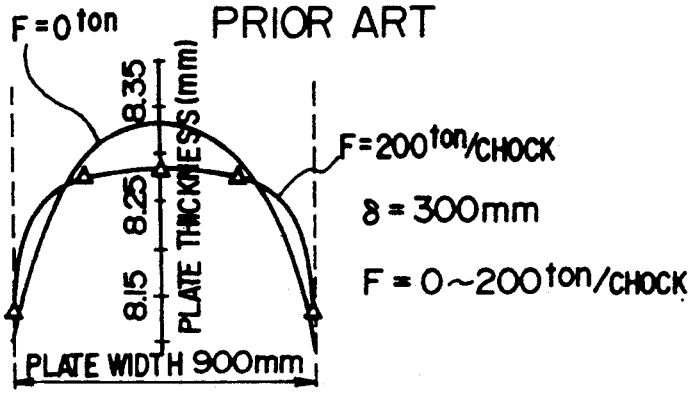
FIG. 14C PRIOR ART

FIG. 13 shows a profile of the plate crown obtained by effecting the plate crown control of the materials of different widths, utilizing the roll shift and the roll bender in the 4-high rolling mill of the present invention which has the upper and lower work rolls each having the curved initial crown (which is shown in FIG. 12 and is represented by a curve of $y=x^2$) on the one side portion of its roll barrel. FIG. 14 shows a profile of the plate crown obtained by effecting the plate crown control of the materials of different widths, utilizing the roll shift and the roll bender in the conventional 4-high rolling mill which has the upper and lower work rolls (shown in FIGS. 2 and 4) each having the initial crown which is formed on the entire roll barrel thereof and is symmetrical with respect to its center. FIGS. 13*a* and 13B show the case (case (A)) where the material width B is 1800 mm, and the distance $\delta$ between the roll end and the lateral edge of the material is 200 mm, and the rolling bending force F is 0 to 200 ton/chock. FIGS. 13B and 14B show the case (case (B)) where the material width B is 1200 mm, and the distance $\delta$ is 300 mm, and the force F is 0 to 200 ton/chock. FIGS. 13C and 14C show the case (case (C)) where the material width B is 900 mm, and the distance $\delta$ is 300 mm, and the force F is 0 to 200 ton/chock. The rolling load is 1.75 ton/mm of the material width in all the cases. Upon comparing FIG. 13 with FIG. 14, in the case (A), the equivalent roll crowns are equal to each other, as described above, and similar plate crowns are obtained. However, with respect to the cases (B) and (C) where the material width is narrower, the plate crown can be changed from a convex shape to a concave shape in the present invention (FIGS. 13B and 13C) by changing the roll bending force F from 0 ton/chock to the maximum value (200 ton/chock), so that the flat plate crown can be obtained. However, in FIGS. 14B and 14C showing the effects of the conventional initial crown, it is only possible to obtain the convex plate crown.

The reason for this will now be mentioned. In the case of the conventional symmetrical roll crown, the geometrical effect by the roll shift is not obtained, and also the end of the effective roll barrel of the work roll is still considerably spaced outwardly from the lateral edge of the material ($\delta=300$ mm), so that the flexing of the work roll is sufficiently reduced, and as a result the plate crown inevitably has the convex shape. On the other hand, with respect to the work roll of the present invention having the curved initial crown, the curved initial crown changes the plate crown directly, that is, geometrically. Therefore, even if a certain degree of flexing of the work roll still remains, the curved initial crown can make the plate crown sufficiently flat. According to the initial crown of this embodiment of the invention, particularly when each work roll is shifted a large amount toward the outside of the rolling mill (that is, projected from the end of the roll barrel of the backup roll) as shown in FIG. 3, the geometrical effect of the initial roll crown is increased, so that the equivalent initial crown is increased. Therefore, particularly when the material width is small, with the distance $\delta$ increased, with the result that the flexing of the work roll is increased, the rolling can be carried out effectively.

Figure 15A:
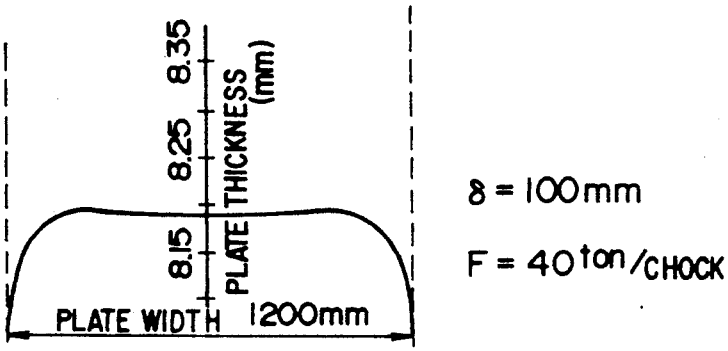
FIGS. 15A to 15C are illustrations showing flat plate crowns obtained by rolling the material to be rolled by the 4-high rolling mill of the invention.
Figure 15B:
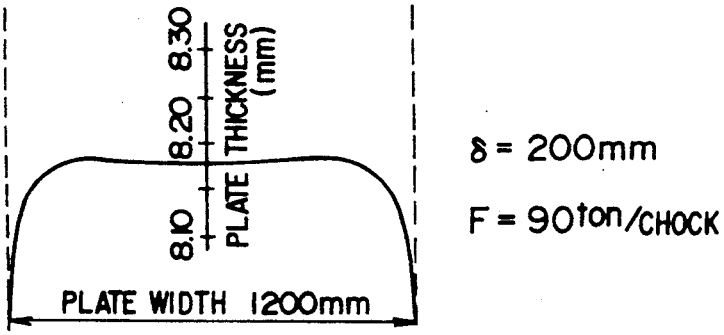
Figure 15C:
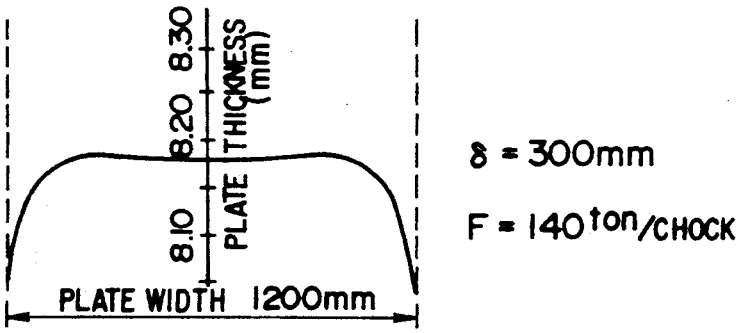

FIG. 15 show the roll bending force F which can make the plate crown flat when the work rolls of the 4-high rolling mill having the initial crown shown in FIG. 12 are cyclically shifted in the range of $\pm 100$ mm with respect to the rolling material having a width of 1200 mm, and also show the plate crown obtained at that time. FIG. 15A shows the case (case (A)) where the distance $\delta$ between the point B at the end of the effective roll barrel of the work roll, having the curved initial crown 1*a*, and the lateral edge of the material is 100 mm. FIG. 15B shows the case (case (B)) where the distance $\delta$ is 200 mm, and FIG. 15C shows the case (case (C)) where the distance $\delta$ is 300 mm. When the shift stroke of the work roll is in the range of $\pm 100$ mm, the roll bending force F is 40 ton/chock in the case (A), and is 90 ton/chock in the case (B), and is 140 ton/chock in the case (C). Thus, the roll bending force F is within the maximum roll bending force of 200 ton/chock in all the cases, and therefore the plate crown can be made sufficiently flat. Therefore, in the 4-high rolling mill of this embodiment of the invention, the plate crown can always be made flat within the amplitude of the cyclic shift necessary for dispersing the wear of the work roll, and the schedule-free rolling can be made while ensuring the equality of the rolled material.

Figure 16:
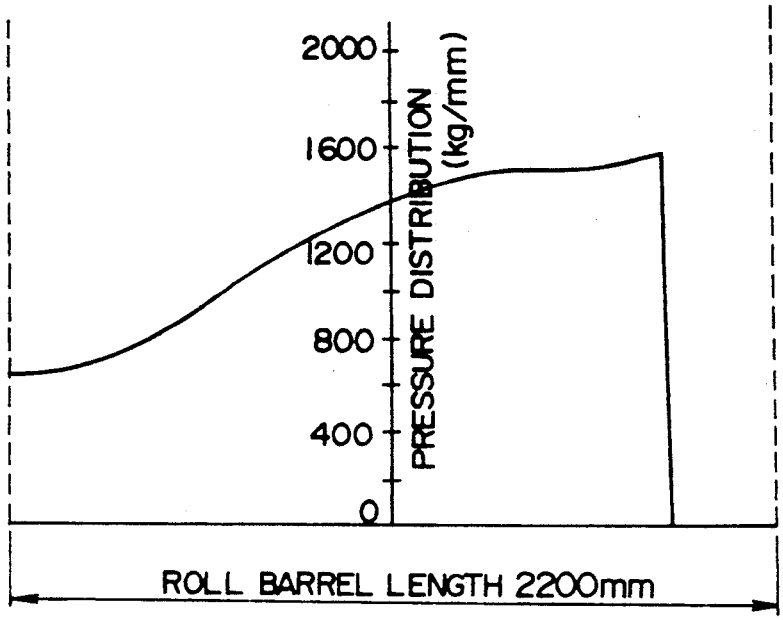
FIG. 16 is a graph showing a pressure distribution between the work roll and the backup roll of the 4-high rolling mill of the invention.
Figure 17:
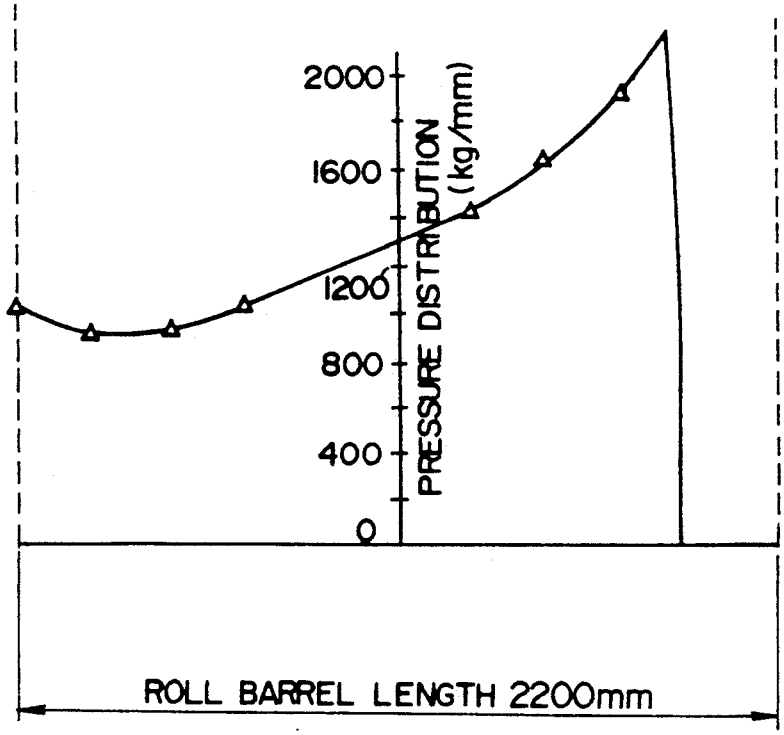
FIG. 17 PRIOR ART
FIG. 17 is a graph showing a pressure distribution between a work roll and backup roll of a conventional 4-high rolling mill.

FIG. 16 shows a distribution of pressure between the work roll and the backup roll produced when the material having a width of 1200 mm is rolled so as to have a flat plate crown, using the 4-high rolling mill of the work roll shift type having the work rolls each having the curved initial crown shown in FIG. 12. FIG. 17 shows a distribution of pressure between the work roll and the backup roll produced when the material having a width of 1200 mm is rolled so as to have a generally flat plate crown, using the conventional 4-high rolling mill of the work roll shift type having the work rolls each having the symmetrical initial crown having a diameter difference of about 150 μm. In order to obtain the flat plate crown, each work roll having the conventional roll crown (FIG. 17) is also shifted and set in such a position that an end of the effective roll barrel is spaced 200 mm ($\delta=200$ mm) outwardly from the lateral edge of the material. From FIGS. 16 and 17, it will be appreciated that the distributions of pressure between the rolls are greatly different from each other. Particularly with respect to the 4-high rolling mill of the embodiment of the present invention, the maximum value of above pressure can be greatly reduced, and therefore great effects can be obtained from the viewpoints of the roll strength and the roll lifetime. Therefore, in the embodiment of the present invention, the frequency of exchange of the rolls is reduced, and the schedule-free rolling can be carried out in an improved manner.

With respect to the above roll initial crown of the present invention, in order to effectively control the plate crown of a wide material, it is desirable that the starting point A of the curved initial crown la on the one side portion of the roll barrel of the work roll 1 shown in FIG. 12 should be provided as close to the center of the roll barrel as possible; however, since the position setting of the work roll in the axial direction can be varied, it is not necessary to strictly provide the starting point at the center of the roll barrel. For example, the starting point A shown in FIG. 12 may be slightly displaced left, in which case a relatively slightly-curved initial crown is provided to extend from this starting point to the center of the roll barrel, and further a curved initial crown represented by $y=x^n$ ($n \geqq 1.5$ to 2.5) is provided to extend from the center of the roll barrel. The other wide portion of the roll barrel has the substantially straight, cylindrical initial crown 1*b*.

According to a modified form of the invention, a special initial crown represented by an expression of the fifth order is provided over the entire effective roll length to extend from the left end of the work roll to its right end. With this arrangement, the initial crown sufficiently approximating to the initial crown of the embodiment shown in FIG. 12 can be obtained. Therefore, it is apparent that such initial crown also falls within the scope of the present invention.

Incidentally, in a hot rolling, as is well known, a large uneven wear is produced on the peripheral surface of the work roll as the rolling operation proceeds. As a result, the plate crown and the plate shape are disturbed, and besides limitation is imposed upon the order of use of materials of different widths, thus adversely affecting the schedule-free rolling. Therefore, it is necessary to eliminate the adverse effects of this uneven wear.

Figure 19A:
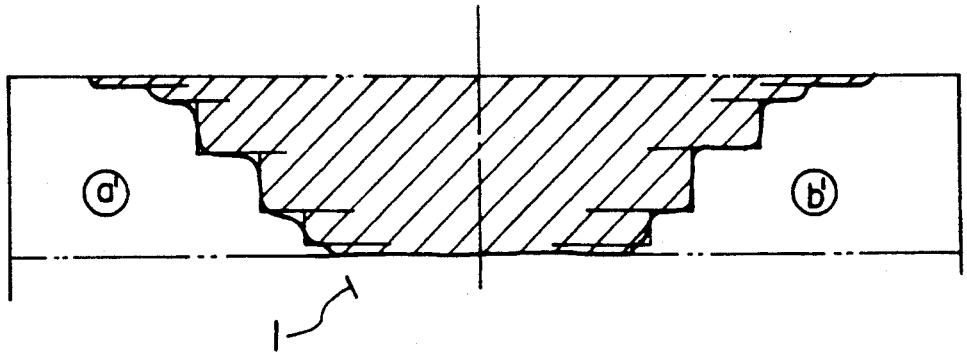
FIG. 19A PRIOR ART
FIG. 19A is a view showing wear of a work roll in a conventional 4-high rolling mill in which the work rolls are not shifted.
Figure 19B:
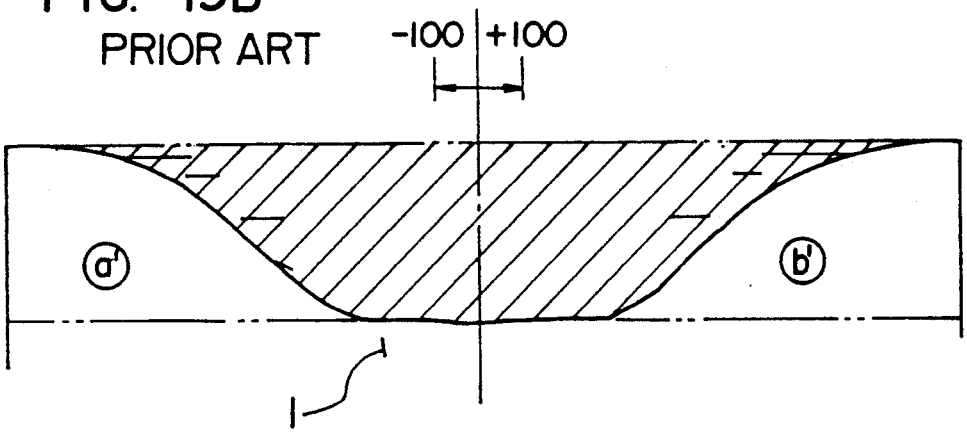
FIG. 19B PRIOR ART
FIG. 19B is a view similar to FIG. 19A, but showing a conventional 4-high rolling mill in which work rolls are cyclically shifted.
Figure 19C:
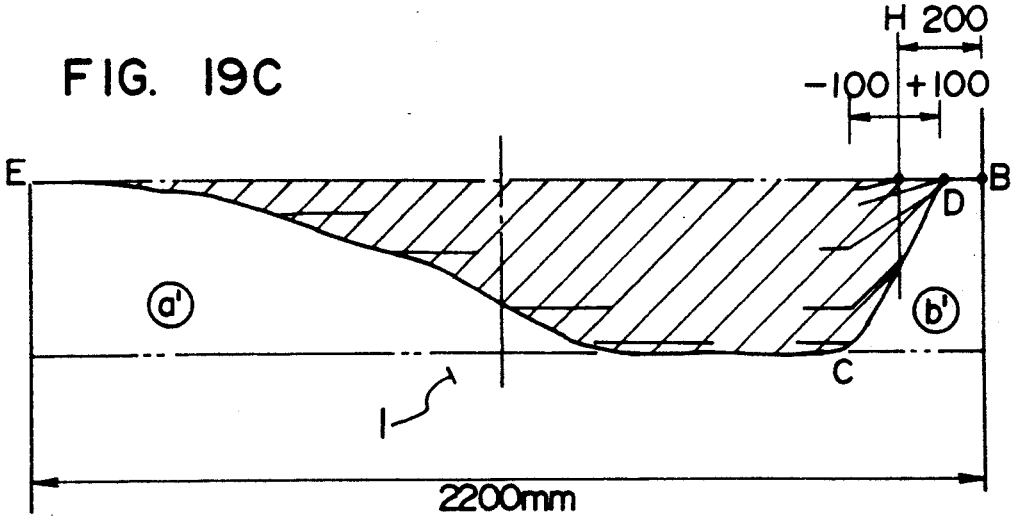
FIG. 19C is a view similar to FIG. 19A, but showing the 4-high rolling mill of the invention.

FIGS. 19A, 19B and 19C show, on an enlarged scale, profiles of roll wear developing on work rolls 1 of various rolling mills, respectively. In each of these Figures, the hatching portion shows the portion removed from the roll surface by the wear, and reference characters (a') and (b') denotes those portions of the roll barrel not subjected to the wear. The length of the roll barrel is 2000 mm. Through the experience of the inventors of the present invention, these roll wear profiles were determined with respect to a most-commonly used hot rolling equipment on the basis of the production percentage of materials to be rolled of various widths shown below.

| Material width (mm) | Production percentage (%) |
|---|---|
| 1800 | 5 |
| 1500 | 8 |
| 1300 | 25 |
| 1000 | 35 |
| 800 | 20 |
| 700 | 7 |

FIG. 19A is related to the rolling mill having no work roll shift, and since large projections and recesses are formed on the portions (a') and (b') of the work roll surface, the schedule-free rolling not be performed.

FIG. 19B shows a case where the wear dispersion is effected in the rolling mill of the work roll cyclic shift type conventionally used most widely. In this case, the work rolls were cyclically shifted ±100 mm from the central position relative to each of the material widths. Better wear dispersion effect is achieved as compared with FIG. 19A, and large projections and recesses are not present in the portions (a') and (b') of the roll barrel. If this roll shift method is applied to a 6-high rolling mill having excellent plate crown and plate shape controls, the schedule-free rolling of a considerable level can be performed; however, the plate crown and plate shape controls are limited in the 4-high rolling mill, and therefore the schedule-free rolling cannot be performed in the 4-high rolling mill.

FIG. 19C is related to the roll shift method for the 4-high rolling mill of the present invention. First, the work roll is much shifted so that the lateral edge of the material can be in registry with the point H spaced 200 mm from the work roll end toward the center of the work roll. Then, the work roll is cyclically shifted ±100 mm from the point H in the direction of the axis of the work roll. The roll wear profile shown in FIG. 19C is obtained at this time. In this case, the roll wear profile is asymmetrical, and particularly in the left side portion (a') (FIG. 19C), the roll wear profile is much gentler than that of FIG. 19B because of the synergistic effect of the cyclic shift and the material width change. Therefore, this is suited for the schedule-free rolling. However, in the right side portion (b') of the roll barrel, the roll wear profile is abrupt, and a peak-like pressure distribution between the work roll and the backup roll develops at this portion. This poses a problem with respect to the strength and lifetime of the roll.

In order to eliminate the various adverse effects of the roll wear shown in FIG. 19, it has been considered to provide the roll grinding devices 40 in the rolling mill, as in the above embodiment of the present invention. When the wear develops, the non-worn portions of the roll surface are removed by the roll grinding device 40 so as to restrain the variation of the roll crown as much as possible.

Namely, with respect to each of the cases of FIGS. 19A, 19B and 19C, the non-worn portions of the surfaces of the portions (a') and (b') are removed by the roll grinding device 40 so as to make the roll crown of the work roll substantially identical to the initial crown, thereby eliminating the adverse effect of the wear. However, in the conventional roll wear shown in FIGS. 19A and 19B, the amount of grinding of those portions to be removed by this grinding method is large, and those portions to be removed exist on the opposite side portions of the roll, and therefore it is necessary to mount many strong grinding devices in the rolling mill. This is disadvantageous from the viewpoints of the economy and maintenance.

The roll shift method of the present invention shown in FIG. 19C can be applied to the 4-high rolling mill having a relatively large-stroke roll shift. However, even if the conventional straight roll is used as the work roll of this rolling mill, or the right-left symmetrical roll crown is applied to the work roll of this rolling mill, the problem of the plate crown and plate shape controls as well as the problem of the roll lifetime must be considered before the problem of the roll wear, as described above. Also, in the type of 4-high rolling mill having work rolls each having S-shaped concave-convex roll crown as disclosed in the above-mentioned Japanese Patent Unexamined Publication No. 57-91807, the right-left such roll crown, it is clear that the 4-high rolling mill provided with the work rolls having the above S-shaped concave-convex roll crown cannot perform its intended function at all.

On the other hand, in the case where the curved roll initial crown is applied to the work roll of the 4-high rolling mill shown in FIG. 12, the roll initial crown is asymmetrical right and left, and also the roll wear is asymmetrical right and left as shown in FIG. 19C. By utilizing these, the load on the roll grinding device is reduced, and even if the number of the roll grinding devices to be used is also reduced to a minimum, the substantially effective roll initial crown can be maintained.

A method of grinding the roll initial crown will now be described.

Figure 20:
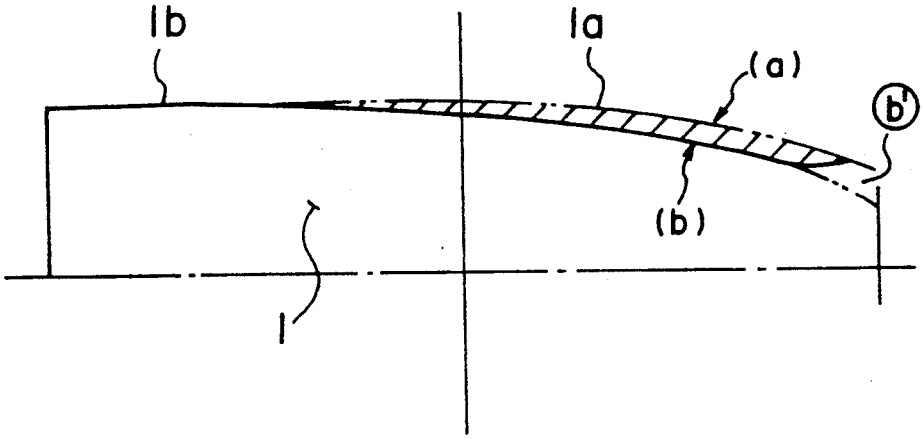
FIG. 20 is a view showing wear developing on the work roll of the 4-high rolling mill of the invention.

FIG. 20 shows a roll profile after wear of the work roll obtained when the work roll having the roll initial crown of the present invention is used according to the roll shift method shown in FIG. 19C. In FIG. 20, the roll profile (b) after wear is substantially similar in shape to the initial roll profile (a) except for the portion (b'). Therefore, in this case, by grinding the portion (b') to remove it, the initial crown is recovered, thereby enabling a schedule-free rolling. In addition, the region of the portion (b') shown in FIG. 20 is about one-fifth (1/5) of the sum of the regions of the portions (a') and (b') shown in FIG. 19C, and exists only in one side portion of the roll. Therefore, the load on the roll grinding device 40 (see FIG. 18) mounted in the rolling mill is greatly reduced, and the number of the roll grinding devices 40 to be used is reduced to a minimum since they are used mainly to grind the portion (b').

Figure 21:
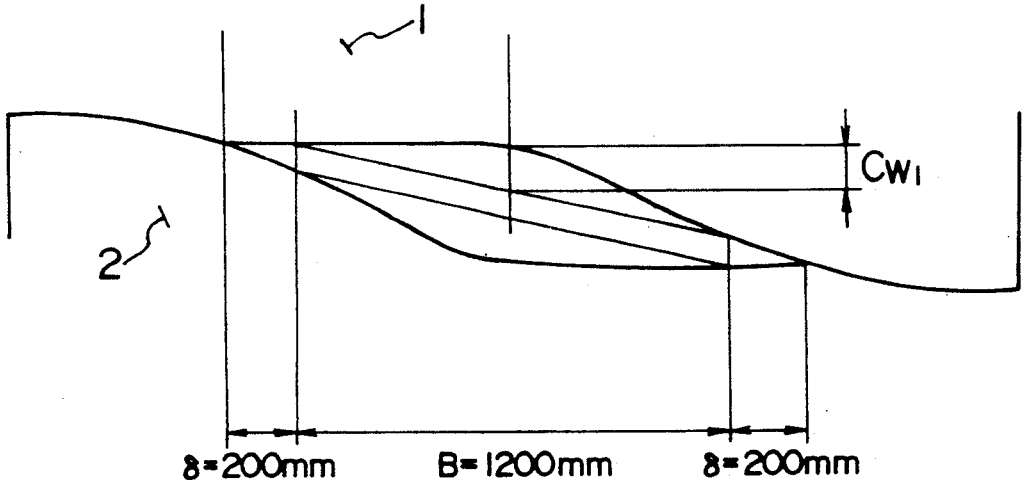
FIG. 21 is a view showing a roll gap between the work rolls of the 4-high rolling mill of the invention, obtained when the roll grinding device is used to grind the work roll barrel.
Figure 22:
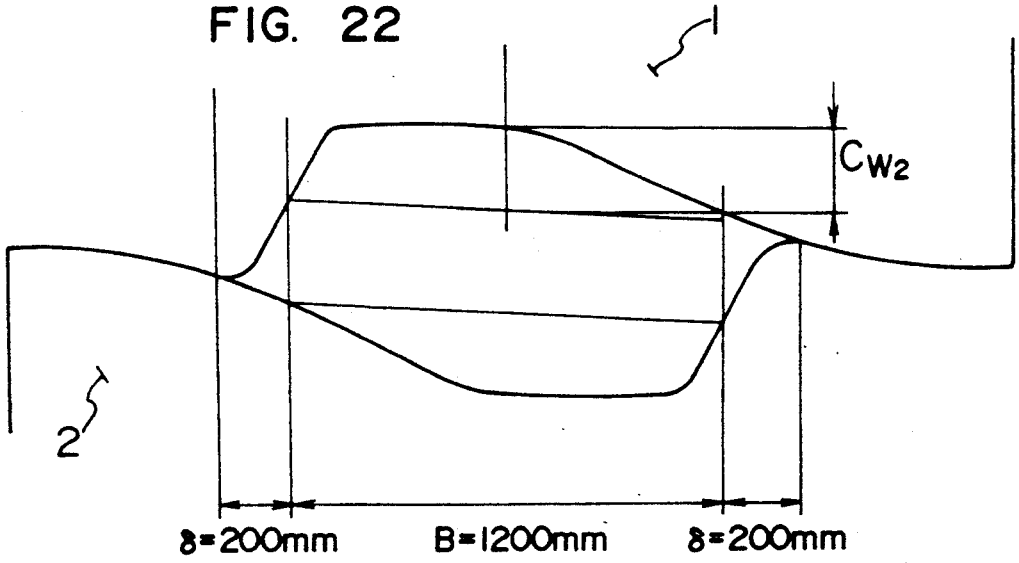
FIG. 22 is a view similar to FIG. 21, but when the roll grinding device is not used.

FIG. 21 shows the influence of the roll wear profile on the profile of the roll gap between the upper and lower work rolls 1, 2 when the portion (b') of FIG. 19C is removed by the roll grinding. FIG. 22 shows the influence of the roll wear profile on the profile of the roll gap between the upper and lower work rolls 1, 2 when the portion (b') of FIG. 19C is not removed by the roll grinding. In FIGS. 21 and 22, the end of each of the work rolls 1 and 2 is shifted outwardly 200 mm ($\delta = 200$ mm) from the lateral edge of the material to be rolled having a width of 1200 mm. As will be appreciated from FIGS. 21 and 22, with respect to the roll crown adversely affecting the plate crown, the roll crown Cw1 obtained by the roll grinding is reduced to about a half of the roll crown Cw2 not subjected to the roll grinding, and with respect to the roll crown Cw1, an abrupt roll crown variation is restrained at the lateral edge of the sheet, thus reducing the edge drop, so that a good plate crown can be easily obtained.

The work rolls, used in the work roll shift-type 4-high rolling mill of the present invention, are usually shifted in their axial direction in accordance with the change of the material width, and therefore, the roll grinding devices are also movable in the direction of the roll axis so as to mainly grind the portion (b') of the roll barrel shown in FIG. 20. Further, if fine projections and recesses on other portions of the roll barrel are ground by the roll grinding devices, making use of this axial movement, the surface quality of the rolled material is further improved. Namely, in FIG. 19C, the force of pressing of the grinding device against the work roll is adjusted to a small level over the region extending from the point E to the point C, thereby removing small projections and recesses. This pressing force is increased over the region extending from the point C to the point D, and is further increased to the maximum level over the region extending from the point D to the point B to remove the non-worn portion (i.e., the portion (b')).

Figure 23:
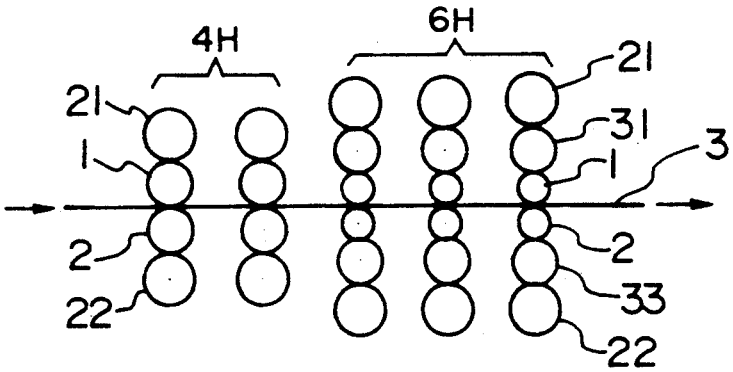
FIG. 23 is a schematic view of a tandem mill using the 4-high rolling mills of the invention shown in FIGS. 9 to 12.

FIG. 23 shows a further embodiment of the invention in which the 4-high rolling mill shown in FIGS. 1, 3 and 9 is applied to a 5-stand hot tandem mill.

In FIG. 23, the 4-high rolling mills each comprising the work rolls with the above-mentioned curved initial crown (provided according to the present invention) and the roll grinding devices are used as the rolling mills of the first and second stands, and 6-high rolling mills (disclosed in the above-mentioned Japanese Patent Examined Publication No. 51-7635) having shiftable intermediate rolls 31 and 33 are used as the rolling mills of the third to fifth stands.

By adopting the above tandem mill, the existing equipment can be relatively easily improved, and the function of the rolling equipment can be markedly improved.

In the above embodiments, although the present invention is directed mainly to the hot strip mill, the present invention, of course, can be applied to a cold strip mill.

What is claimed is:

1. A 4-high rolling mill comprising:

a pair of upper and lower work rolls for rolling a material to be rolled;

a pair of upper and lower backup rolls supporting said upper and lower work rolls, respectively;

a roll bending device for applying a bending force to said upper and lower work rolls; and a roll shift device for shifting said upper and lower work rolls in an axial direction of said work rolls;

each of said upper and lower work rolls having a curved initial crown portion formed on one side portion of a barrel of said work roll which is not less than a half of a length of said work roll barrel, and a substantially cylindrical initial crown portion formed on a remainder of said work roll barrel, said curved initial crown portion and said cylindrical initial crown portion forming a working region for reducing a workpiece therebetween and said remainder having a length substantially greater than zero, a curve of said curved initial crown portion approximating a curve represented by the formula $Y=X^n$, where X represents a non-dimensioned coordinate in an axial direction of the roll, Y represents an amount of displacement in a direction perpendicular to the axial direction, and n is a number greater than 1.5 and said curved initial crown portions of said upper and lower work rolls being disposed oppositely relative to each other in the axial direction of said work rolls, and always disposed in overlapping direction to each other at at least a part thereof.

2. A 4-high mill according to claim 1, wherein "n" is between 2.0 and 2.5.

3. A 4-high rolling mill according to claim 1, wherein a maximum shift amount of said roll shift device is about ½ of the difference between a predetermined maximum and minimum width of the material to be rolled.

4. A 4-high rolling mill for installation at a forward stage of a tandem rolling mill, comprising:

a pair of upper and lower work rolls for rolling a material to be rolled, said work rolls being provided with a roll being device;

a pair of upper and lower backup rolls supporting said upper and lower work rolls, respectively; and a roll shift device for shifting said upper and lower work rolls in an axial direction of said work rolls;

each of said upper and lower work rolls having a curved initial crown portion formed on one side portion of a barrel of said work roll which is not less than a half of a length of said work roll barrel, and a substantially cylindrical initial crown portion formed on a remainder of said work roll barrel, said curved initial crown portion and said cylindrical initial crown portion forming a working region for reducing a workpiece therebetween and a curve of said curved initial crown portion approximating a curve represented by the formula $y=x^n$, where X represents a non-dimensioned coordinate in an axial direction of the roll, Y represents an amount of displacement in a direction perpendicular to the axial direction, and n is a number greater than 1.5 and said curved initial crown portions of said upper and lower work rolls being disposed oppositely relative to each other in the axial direction of said work rolls, and always disposed in overlapping direction to each other at at least a part thereof.

5. A rolling method comprising the steps of:

providing a 4-high rolling mill comprising (a) a pair of upper and lower work rolls for rolling a material to be rolled, said work rolls being provided with a roll bending device, (b) a pair of upper and lower backup rolls supporting said upper and lower work rolls, respectively, and (c) a roll shift device for shifting said upper and lower work rolls in an axial direction of said work rolls, each of said upper and lower work rolls having a curved initial crown portion formed on one side portion of a barrel of said work roll which is not less than a half of a length of said work roll barrel, and a substantially cylindrical initial crown portion formed on a remainder of said work roll barrel said curved initial crown portion and said cylindrical initial crown portion forming a working region for reducing a workpiece therebetween and, a curve of said curved initial crown portion approximating a curve represented by the formula $Y=X^n$where X represents a non-dimensioned coordinate in an axial direction of the roll, Y represents an amount of displacement in a direction perpendicular to the axial direction, and n is a number greater than 1.5 said curved initial crown portions of said upper and lower work rolls being disposed oppositely relative to each other in the axial direction of said work rolls, and always disposed in overlapping relation to each other at at least a part thereof;

shifting each of said upper and lower work rolls axially in such a manner that an end of an effective length of said work roll barrel is disposed outwardly of a lateral edge of the material to be rolled; and shifting each of said upper and lower work rolls cyclically axially within a predetermined range during rolling operations.

6. A rolling method according to claim 5, wherein each of said upper and lower work rolls is shifted in such a manner than an end of an effective length of said work roll barrel is disposed inwardly of an end of an effective length of a barrel of a corresponding one of said upper and lower backup rolls.

7. A rolling method according to claim 5, wherein a bending force applied to said upper and lower work rolls from said roll bending device is so adjusted that a change of plate crown of the material accompanied with the cyclic shift of said upper and lower work rolls is amended.

8. A 4-high rolling mill comprising:

a pair of upper and lower work rolls for rolling material to be rolled each of said upper and lower backup rolls having a curved initial crown portion formed on one side portion of a barrel of said work roll which is not less than a half of a length of said work roll barrel, and a substantially cylindrical initial crown portion formed on a remainder of said work roll barrel, said curved initial crown portion and said cylindrical initial crown portion forming a working region for reducing a workpiece therebetween and a curve of said curved initial crown portion approximating a curve represented by the formula $Y=X^n$, where X represents a non-dimensioned coordinate in an axial direction of the roll, Y represents an amount of displacement in a direction perpendicular to the axial direction, and n is a number greater than 1.5 said curved initial crown portions of said upper and lower work rolls being disposed oppositely relative to each other in the axial direction of said work rolls, and always disposed in overlapping direction to each other at at least a part thereof;

a pair of upper and lower backup rolls supporting said upper and lower work rolls, respectively;

a roll bending device for applying a bending force to said upper and lower work rolls;

a roll shift device for shifting said upper and lower work rolls in an axial direction of said work rolls; and a roll grinding device movable in the direction of said work rolls so as to grind a barrel surface of each of said upper and lower work rolls to maintain shape of said initial crown portion.

9. A 4-high rolling mill according to claim 8, wherein "n" is between 2.0 to 2.5

10. A 4-high rolling mill according to claim 8, wherein a maximum shift amount of said roll shift device is about ½ of the difference between a maximum and a minimum width of the material to be rolled.

11. A 4-high rolling mill for installation of a forward stage of a tandem rolling mill, comprising:

a pair of upper and lower work rolls being provided with a roll bending device, each of said upper and lower work rolls having a curved initial crown portion formed on one side portion of a barrel of said work roll which is not less than a half of a length of said work roll barrel, and a substantially cylindrical initial crown portion formed on a remainder of said work roll barrel, said curved initial crown portion and said cylindrical initial crown portion forming a working region for reducing a workpiece therebetween and a curve of said curved initial crown portion approximating to a curve represented by the formula $y=x^n$, where X represents a non-dimensioned coordinate in an axial direction of the roll, Y represents an amount of displacement in a direction perpendicular to the axial direction, and n is a number greater than 1.5 and said curved initial crown portions of said upper and lower work rolls being disposed oppositely relative to each other in the axial direction of said work rolls, and always disposed in overlapping direction to each other at at least a part thereof;

a pair of upper and lower backup rolls supporting said upper and lower rolls, respectively;

a roll shift device for shifting said upper and lower work rolls in an axial direction of said work rolls; and a roll grinding device movable in the direction of said work rolls so as to grind a barrel surface of each of said upper and lower work rolls to maintain shape of said initial crown portion.

12. A rolling method comprising the steps of:

providing a 4-high rolling mill comprising (a) a pair of upper and lower work rolls for rolling a material to be rolled, said work rolls being provided with a roll bending device, and each of said upper and lower work rolls having a curved initial crown portion formed on one side portion of a barrel of said work roll which is not less than a half of a length of said work roll barrel, and a substantially cylindrical initial crown portion formed on a remainder of said work roll barrel, said curved initial crown portion and said cylindrical initial crown portion forming a working region for reducing a workpiece therebetween and a curve of said curved initial crown portion approximating to a curve represented by the formula $Y=X^n$, where X represents a non-dimensioned coordinate in an axial direction of the roll, Y represents an amount of displacement in a direction perpendicular to the axial direction, and n is a number greater than 1.5 said curved initial crown portions of said upper and lower work rolls being disposed oppositely relative to each other in the axial direction of said work rolls, and always disposed in overlapping relation to each other at at least a part thereof, (b) a pair of upper and lower backup rolls supporting said upper and lower work rolls, respectively, (c) a roll shift device for shifting said upper and lower work rolls in an axial direction of said work rolls, and (c) a roll grinding device for grinding each of said upper and lower work rolls;

shifting each of said upper and lower work rolls axially in such a manner that an end of an effective length of said work roll barrel is disposed outwardly of a lateral edge of the material to be rolled;

shifting each of said upper and lower work rolls cyclically axially within a predetermined range during rolling operations; and moving said roll grinding device in the axial direction of said work rolls so as to grind a barrel surface of each of said upper and lower work rolls to maintain shape of said initial crown portion.

13. A rolling method according to claim 12, wherein each of said upper and lower work rolls is shifted in such a manner than an end of an effective length of said work roll barrel is disposed inwardly of an end of an effective length of a barrel of a corresponding one of said upper and lower backup rolls.

14. A rolling method according to claim 12, wherein a bending force applied to said upper and lower work rolls from said roll bending device is so adjusted that a change of a plate crown of the material accompanied with the cyclic shift of said upper and lower work rolls is amended.

15. A rolling method according to claim 12, wherein said roll grinding device deeply grinds mainly a portion of said curved initial crown portion near an end of said work roll barrel so as to maintain a curve of said curved initial crown portion.

16. A rolling method according to claim 12, wherein a force of pressing of said roll grinding device against the surface of the work roll barrel of each of said upper and lower work rolls is adjusted in accordance with the movement of said roll grinding device along an axis of said work roll.

17. A rolling method according to claim 12, wherein the grinding of said initial crown portion by said roll grinding device is carried out during rolling operations.

* * * * *